US010251433B2

(12) United States Patent
Roberts et al.

(10) Patent No.: US 10,251,433 B2
(45) Date of Patent: Apr. 9, 2019

(54) WEARABLE GARMENT

(71) Applicant: IMPACT TECH LABS LIMITED, Twickenham, Middlesex (GB)

(72) Inventors: Jason Lloyd Roberts, St. Margaret's (GB); Wilhelm Marschall, London (GB); Haim Geva, London (GB); Kemal Dervish, Welwyn Garden City (GB)

(73) Assignee: NURVV LIMITED, Twickenham (GB)

( * ) Notice: Subject to any disclaimer, the term of this patent is extended or adjusted under 35 U.S.C. 154(b) by 435 days.

(21) Appl. No.: 15/058,698

(22) Filed: Mar. 2, 2016

(65) Prior Publication Data

US 2017/0127736 A1 May 11, 2017

(30) Foreign Application Priority Data

Nov. 5, 2015 (GB) ..... 1519576.1

(51) Int. Cl.

| | |
|---|---|
| ***A41D 13/015*** | (2006.01) |
| ***A41D 1/00*** | (2018.01) |
| ***A41D 31/00*** | (2006.01) |
| *A41D 13/05* | (2006.01) |

(52) U.S. Cl.

CPC ..... *A41D 13/015* (2013.01); *A41D 1/002* (2013.01); *A41D 31/005* (2013.01); *A41D 13/0581* (2013.01)

(58) Field of Classification Search

CPC ..... A41D 1/002; A41D 13/015; A41D 13/05; A41D 13/0581; A41D 31/005; A63B 71/08; A63B 2220/50; G01N 3/30; G01N 3/303; G01N 3/307; G01N 3/31; G01N 3/313; G01N 3/317

USPC ..... 73/11.04, 504.03; 463/8

See application file for complete search history.

(56) References Cited

U.S. PATENT DOCUMENTS

| | | | | |
|---|---|---|---|---|
| 5,629,673 | A | 5/1997 | Juhasz | |
| 7,008,231 | B2 * | 3/2006 | Pesnell | A63B 59/20 434/247 |
| 2002/0060633 | A1 | 5/2002 | Crisco, III et al. | |

(Continued)

FOREIGN PATENT DOCUMENTS

| | | |
|---|---|---|
| CN | 103048068 A | 4/2013 |
| CN | 204275461 U | 4/2015 |

(Continued)

OTHER PUBLICATIONS

Tamez-Duque, Jesus et al., "Real-Time Strap Pressure Sensor System for Powered Exoskeletons", Sensors 2015, 15, 4550-4563; doi:10.3390/s150204550, Feb. 16, 2015.*

(Continued)

*Primary Examiner* — Lisa M Caputo
*Assistant Examiner* — Irving A Campbell
(74) *Attorney, Agent, or Firm* — Stites & Harbison, PLLC; Jeffrey A. Haeberlin

(57) ABSTRACT

A wearable garment includes at least one impact absorbing pad with an inner face facing the body of a wearer and an opposite outer face, and a pressure sensor on the side of the pad faced by the inner face of the pad positioned so as to measure the effect at the inner face of an impact on the outer face after a portion of the impact has been absorbed by the pad.

14 Claims, 6 Drawing Sheets

(56) References Cited

U.S. PATENT DOCUMENTS

| | | | | |
|---|---|---|---|---|
| 2003/0070209 | A1* | 4/2003 | Falone | A41D 13/015 2/412 |
| 2006/0254369 | A1 | 11/2006 | Yoon et al. | |
| 2007/0021269 | A1 | 1/2007 | Shum | |
| 2008/0307899 | A1 | 12/2008 | Von Lilienfeld-Toal et al. | |
| 2009/0293587 | A1 | 12/2009 | Mages | |
| 2010/0162832 | A1 | 7/2010 | Brauers | |
| 2011/0282164 | A1 | 11/2011 | Yang et al. | |
| 2012/0143526 | A1 | 6/2012 | Benzel et al. | |
| 2012/0210498 | A1 | 8/2012 | Mack | |
| 2012/0323501 | A1 | 12/2012 | Sarrafzadeh et al. | |
| 2013/0077263 | A1 | 3/2013 | Oleson et al. | |
| 2013/0110415 | A1 | 5/2013 | Davis et al. | |
| 2013/0167663 | A1 | 7/2013 | Eventoff | |
| 2013/0190903 | A1* | 7/2013 | Balakrishnan | A61B 5/7246 700/91 |
| 2013/0192071 | A1 | 8/2013 | Esposito et al. | |
| 2014/0083207 | A1 | 3/2014 | Eventoff | |
| 2014/0088454 | A1 | 3/2014 | Mack | |
| 2014/0101831 | A1* | 4/2014 | Balzano | A41D 13/0002 2/455 |
| 2014/0303529 | A1 | 10/2014 | Park et al. | |
| 2014/0333446 | A1 | 11/2014 | Newlove | |
| 2015/0059494 | A1 | 3/2015 | Stanzione | |
| 2015/0190052 | A1 | 7/2015 | Vaitaitis | |
| 2015/0282759 | A1 | 10/2015 | Lin et al. | |
| 2015/0297973 | A1 | 10/2015 | Beers | |

FOREIGN PATENT DOCUMENTS

| | | | |
|---|---|---|---|
| CN | 204709754 | U | 10/2015 |
| CN | 204709755 | U | 10/2015 |
| WO | 0048692 | A1 | 8/2000 |
| WO | 2015048180 | A2 | 4/2015 |

OTHER PUBLICATIONS

Intellectual Property Office (United Kingdom), Search Report issued in corresponding GB Application No. 1519576.1, dated Apr. 20, 2016.

* cited by examiner

WEARABLE GARMENT

BACKGROUND OF THE INVENTION

1. Field of the Invention

The present invention is directed to a wearable garment comprising at least one impact absorbing pad.

2. Description of Related Art

Wearable garments with impact absorbing pads are known in numerous applications. In particular, they are widely used in sports where the wearer's body is likely to be subjected to an impact. For example, in rugby, football (US), boxing, horse riding and cricket. In addition, in activities such as motorcycling and cycling, impact absorbing pads are built into helmets, jackets and trousers which provide a degree of protection to the body of a user.

Also of relevance to the present invention are a number of developments in the field of "smart clothing". Examples of smart clothing include pedometers, gyroscopes and heart rate monitors built into garments. These are generally used to measure parameters such as distance travelled, speed, acceleration and heart rate. These can be used to provide an indication to a user of various parameters such as energy expended, distance travelled, etc.

Of particular relevance to the present invention are developments in smart clothing in the field of impact detection. The applicant is aware of a number of systems which are designed to indirectly measure the impact on a body. These include the xPatch manufactured by X2 Biosystems. This is a patch which is designed to be taped behind the ear of a user and provides six axis acceleration measurements. The Checklight manufactured by Reebok includes an accelerometer and a gyroscope built into a skull cap. The skull cap has red, yellow and green lights which are lit depending upon the severity of the detected impact. The Shockbox from i1 provides a similar device. Also, the blast gauge system manufactured by Blackbox Biometrix is a sensor system which monitors pressure and acceleration to determine exposure to explosive blasts in a military context.

We are also aware of a golfing glove known as the Sensoglove® which has inbuilt pressure sensors to provide an analytic tool for a trainer in determining how hard a user is gripping a club.

US 2015/0059494 discloses a system for monitoring and measuring impact forces imparted to an individual. This has a multi-layer plate which might be incorporated into an item of clothing. A sensor is provided towards the outer face of the plate.

BRIEF SUMMARY OF THE INVENTION

The present invention is aimed at providing an improvement of the above devices.

According to the present invention, there is provided a wearable garment as defined in claim 1.

The use of a pressure sensor in this way is unique. As mentioned above, most of the devices rely on an accelerometer optionally in combination with a gyroscope. The Blackbox device has a pressure sensor, but this is intended to measure a blast pressure with the impact force being measured by an accelerometer.

In the case of the golf glove, there is no disclosure of an impact absorbing pad and no desire to measure an impact force. In US 2015/0059494, the sensor is positioned towards the outer surface of the plate. As such, it cannot measure the effectiveness of the impact absorbing pad because it is on the wrong side of most of the pad.

By measuring the pressure which has actually been transmitted through the impact absorbing pad and by doing this with a pressure sensor, the present invention is able to make a more accurate determination of the force that the body actually experiences than is currently possible with the prior art.

The present invention only directly measures the pressure downstream of the impact absorbing pad. The garment may optionally comprise a second sensor adjacent to the outer face of the pad to directly measure the impact force. However, preferably, the garment further comprises a means to calculate the impact force on the outer face of the impact absorbing pad based on the force measured at the inner face. This means may take the form of a control system which is programmed with a padding dampening factor relating to the impact absorbing capacity of the material. This factor is determined as a ratio of the amount of transmitted force to the incident force for a given force. Such a value is preferably determined by experimentation by testing of samples of the material.

In practice, the incident force on the outer face of the pad may not be normal to the surface of the pad. On the other hand, the pressure sensor is only capable of measuring the normal component of the transmitted force. In this and the subsequent description, the incident force refers to the impact force on the outer face of the pad. The transmitted force refers to the force on the opposite side of the pad.

At a first approximation, it is possible to rely only on measuring this normal component on the basis that this is the most harmful force to a wearer. Thus, a relatively high force applied at a relatively high angle of incidence (with respect to the normal direction) effectively represents a "glancing blow" to a user such that it is sufficient only to determine the normal components of this force.

Preferably, however, the wearable garment further comprises an accelerometer and a gyroscope to measure the changes in velocity (magnitude and direction) due to a collision.

This information, coupled with the padding dampening factor referred to above allows the direction and magnitude of the incident force to be calculated by solving the equations of motion using laws of momentum and energy conservation.

The impact absorbing pad is a pad designed to provide a reasonable degree of cushioning for a user by absorbing a proportion of the applied force. The proportion of the absorbed force may vary to some degree depending on the peak force of the impact and so the properties of the impact absorbing pad can be described based on a dampening factor at a chosen force 7 kN. Preferably, the impact absorbing pad has a dampening factor at 7 kN of greater than 10%, preferably greater than 50% and most preferably greater than 85%. The dampening factor is determined for a specific material by subjecting the material to a number of incident forces of different magnitudes and measuring the transmitted force on the opposite side of the material.

A calibration curve is then obtained from these measurements for use in such calculations. A dampening factor at 7 kN of greater than 10%, for example, signifies that the pad will absorb 10% of the incident force.

In the broadest sense, the present invention requires just two layers, namely the impact absorbing pad and the pressure sensor.

The sensor itself may be treated on its inner face such that it has a layer which is comfortable against the skin. However, preferably, an inner fabric layer is provided covering the inner face of the pressure sensor to provide enhanced comfort, breathability and wicking properties at the interface with the users body.

An outer fabric layer may be provided covering the outer face of the pad. This will enhance the appearance of the garment as the pad is not exposed at the outer face of the garment.

The first and second fabric layers may be multi-layered to provide enhanced comfort properties for the wearer. There may be further layers between the pad, sensor, and fabric layers.

The pressure sensor itself may be a single sensor able to measure pressure at one particular location. Such a sensor would be suitable for a garment where it is only necessary to detect the force in a relatively small region. Alternative, an array of such pads and sensors may be provided across a wider area.

However, preferably, the pressure sensor is in the form of a matrix array which is able to detect pressure changes across a substantial portion of the width of the impact absorbing pad.

The sensor may be a capacitive sensor (for example, as described in US2013167663) or a strain gauge. It is preferably a resistive sensor, such as an analogue resistive sensor constructed to translate applied force into electrical resistance.

The nature of the impact absorbing pad, particularly when it has an impact dissipating layer, is that an incident force will be spread across a relatively wide area. A matrix array sensor that will measure a force increase across the whole of such an area and an average from the sensors may be taken across this area. Alternatively, a "force profile" for the impact may be measured in which forces at individual locations are measured. In either event, the sensor will measure both the force and the area over which the force is applied allowing the pressure to be calculated.

When using such an array, it is desirable to spread the detected force across as wide an area as possible.

Therefore, preferably, an impact dissipating layer which has a higher flexural rigidity than the impact absorbing pad is embedded within the impact absorbing pad to dissipate the incident force across a wider area of the body.

In its simplest form, the garment may comprise a single pad and sensor. The sensor may include some means of recording the sensed data which can be accessed at a later date.

However, preferably, the wearable garment further comprises a control module with an electrical connection to the pressure sensor. For larger garments, such as a top designed to be worn on the upper body, there may be a plurality of impact absorbing pads each with its own pressure sensor and each being connected to the control module.

If the garment includes an accelerometer and gyroscope as set out above, these are preferably housed in the control module.

The control module also preferably comprises a processing unit to receive the sensed data and, carry out any required calculation of the incident force and to control the transmission of data as required.

The control module also preferably comprises a transceiver which is able to transmit and receive data wirelessly. This may be any known type of wireless communication such as cellular, Bluetooth, Wi-Fi, sub 1 GHz radio or radio. The garment may also incorporate GPS technology to enable the location of the wearer to be determined.

The control module preferably also comprises a battery such as a lithium ceramic battery. This is particularly suited to such an application and due to its safety qualities.

The control module preferably also includes an on/off switch. It may also include one or more LEDs to provide an on/off status, charging status and/or an indication of the magnitude of impact force.

The control module may also be provided with a memory in order to store a detected data. Alternatively, it may transmit this wirelessly in real time to be stored externally. The frequency with which a control device transmits the data will be determined by requirement. At one end of the scale, it can be streamed immediately. On the other end, it may simply all be stored on the control module and downloaded at a later date once a user has stopped wearing the garment. Otherwise, the data may be transmitted at regular intervals every few seconds or minutes.

The control module may be entirely encapsulated in the waterproof housing such that it can be washed together with the garment. Alternatively, the control module is removable. Similarly, the or each pressure sensor may be encapsulated or removable as necessary.

The garment in question may be one or more selected from the group containing a T-shirt, long sleeve top, jacket, harness, helmet, leggings, shorts, gloves (e.g. boxing gloves or cricket gloves), or an individual padding item attachable to the body, such as a thigh pad, chest guard, shin guard, cricket pads and neck brace. The garment may be a "skeleton" type garment which does not necessarily form a complete garment but is designed to be worn under another garment.

The present invention also extends to a system comprising a wearable garment according to a first aspect of the present invention in combination with a data processing and display device arranged to receive information from the pressure sensor. The data processing and display device may be a computer or a mobile communications device such as a smart phone or tablet.

Such a device may receive data from the control module and the additional sensors associated with the control module. The system may also include additional sensors such as pedometers, heart rate monitors and the like which may or may not be integral with the garment.

The processing and display device may be arranged to receive data from a single garment if it is intended solely for personal use.

Alternatively, it may be arranged to receive data from a plurality of garments. This may be useful, for example, for a team coach to monitor information for all members of the team.

Alternatively, it may be useful for medical practitioners to gather data from a wide variety of users in order to make a global assessment of a particular category of users and the effect of impact on them. The data may also be used as information, for example on a TV sports broadcast or on social media to allow for interaction.

An example of a garment in accordance with the present invention will now be described with reference to the accompanying drawings, in which:

BRIEF DESCRIPTION OF THE DRAWINGS

FIG. 10 is a perspective view of the garment of FIGS. 1A and B;

DETAILED DESCRIPTION OF EXEMPLARY EMBODIMENTS OF THE INVENTION

FIGS. 1A to D show a padded top which is a type of padded underlayer intended for use by a rugby player. As described elsewhere in this application, the invention is applicable to wearable garments in general where impact protection is required. Whilst the top illustrated in FIGS. 1A to D is being used as an illustration, it will be readily understood that, for other such garments, the impact absorbing pads are placed in the areas most likely to receive an impact.

Figure 1B:
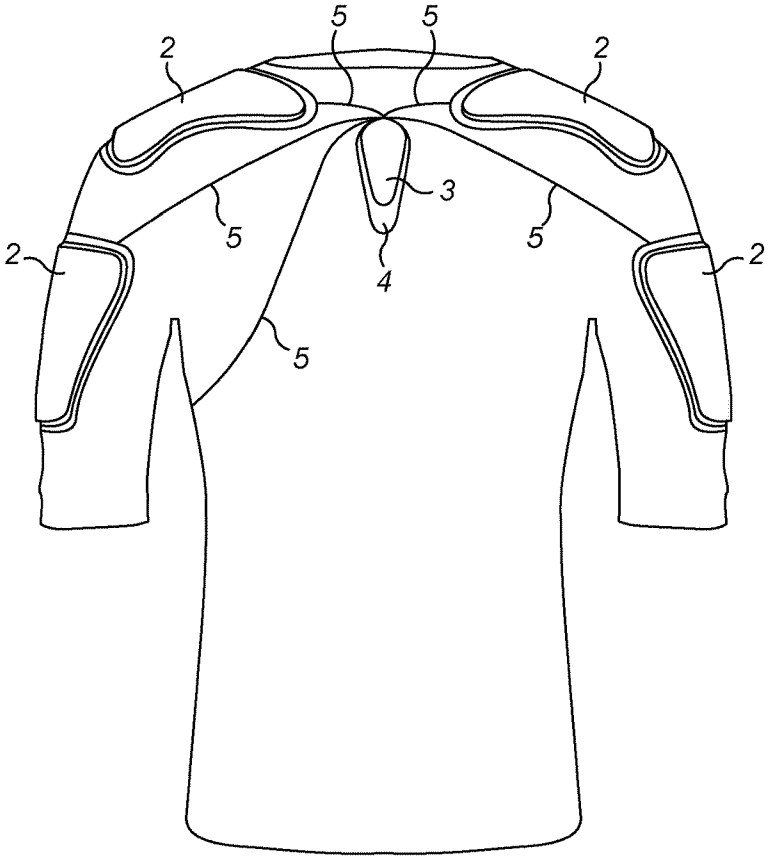
FIG. 1B is a back view of the garment of FIG. 1A.
Figure 1A:
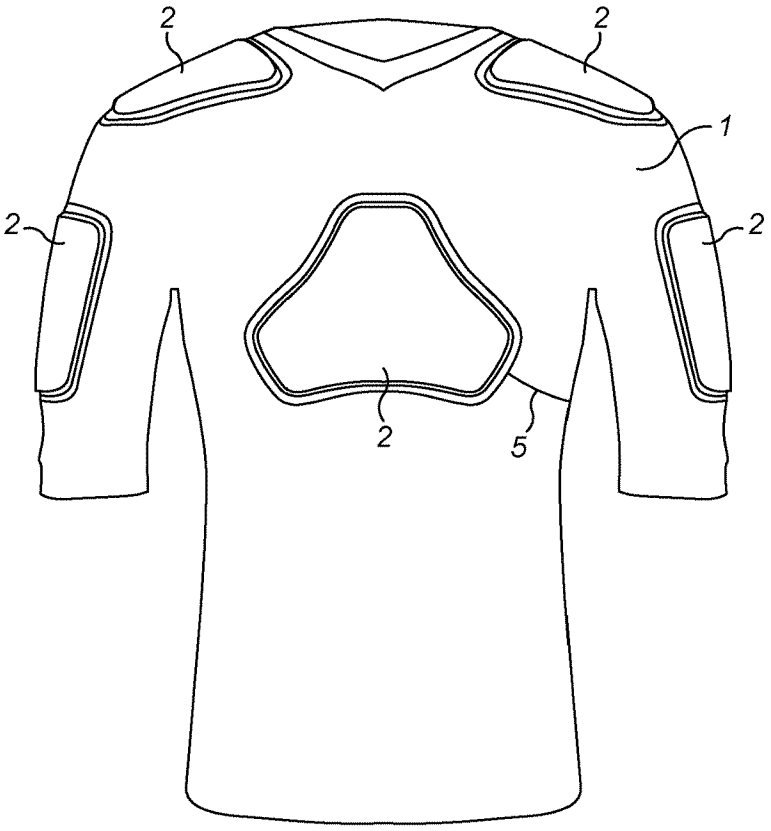
FIG. 1A is a front view of a garment according to the present invention.
Figure 1C:
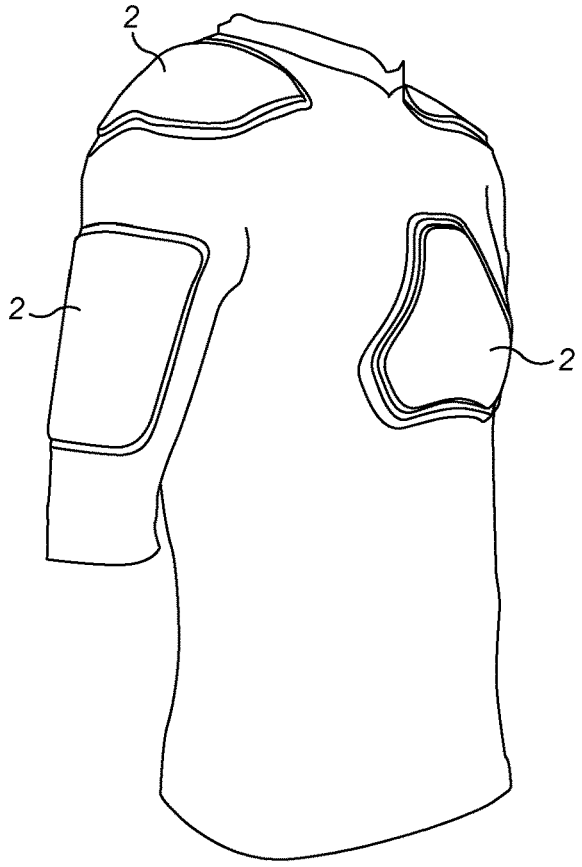
FIG. 1D is a top view of the garment of the previous Figures.
Figure 1D:
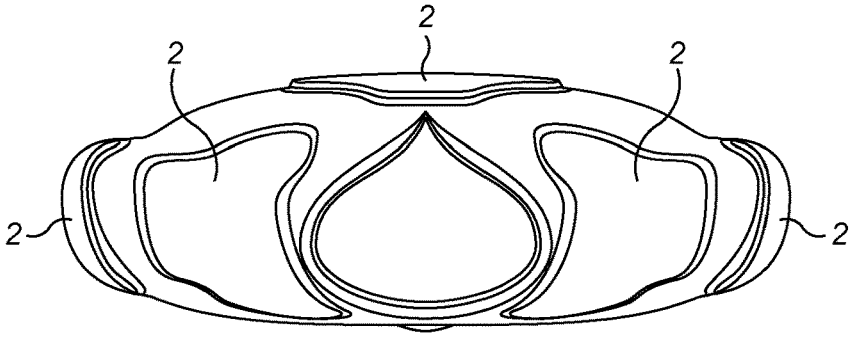

As shown in FIGS. 1A to C, the garment 1 comprises five impact absorbing pads 2 comprising a pair of shoulder pads, a pair of upper arm pads and a chest pad. Towards the upper part of the back of the garment 1 is a control module 3. This is surrounded by a soft layer 4 to provide comfort for the person wearing the garment as well as anyone impacting on them. The control module 3 is connected via an electrically conductive line 5 to each of the pads 2. The line 5 may simply be a wire which is retained between layers of the garment so that it does not impede the wearer.

The number and positioning of pads is provided as one example only. There may be fewer pads, for example just the shoulder pads, or additional pads, such as pads which protect the ribs.

Figure 2:
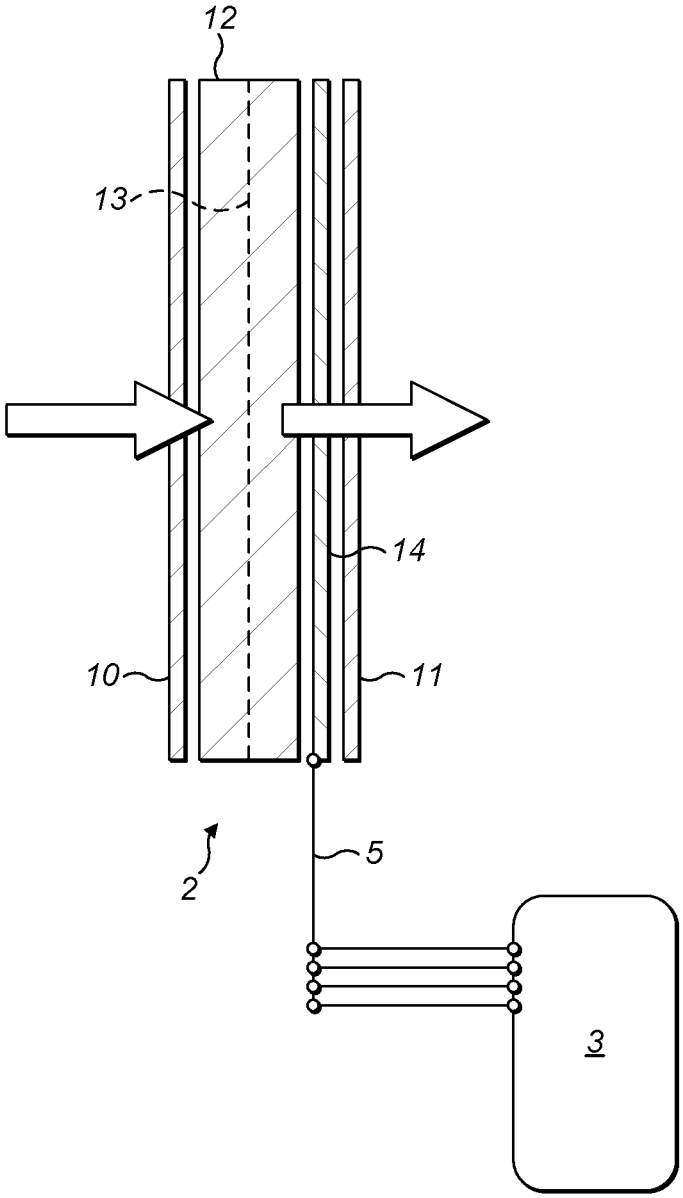
FIG. 2 is a schematic cross-section through various layers of the pad, sensor and garment.

FIG. 2 shows the structure of the pad 2 in greater detail. The pad is sandwiched between an outer fabric layer 10 and an inner fabric layer 11. The pad consists of an impact absorbing layer 12. This may be made of a material such as foamed elastomers, thermoplastic elastomers, foamed thermoplastic elastomers or any suitable compliant material. This layer 12 will generally be less than 100 mm thick, more preferably less than 50 mm thick and most preferably less than 20 mm thick. Within the impact absorbing material 12 is an impact dissipating layer 13. This is an optional layer. This may be embedded in the impact absorbing material at the point of manufacture. Alternatively, the impact absorbing material 12 may be formed of two parts which are sandwiched around the impact dissipating layer 13. The impact dissipating layer 13 may be high impact engineering polymers (such as polycarbonate or nylon), glass or carbon fibre composites, bi-axial oriented films or any other material which provides high flexural strength, high puncture resistance and flexibility.

Figure 3A:
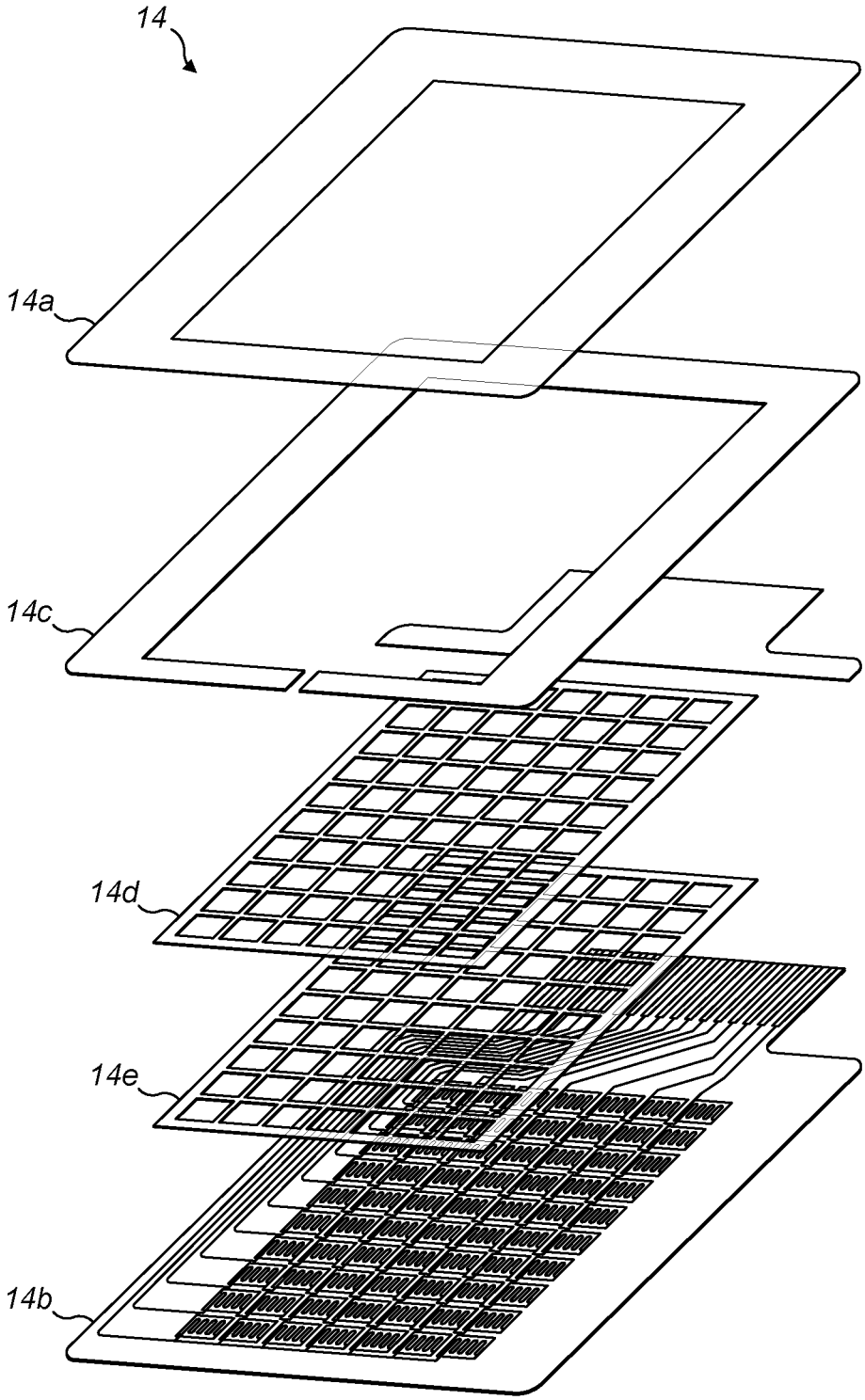
FIG. 3A is an exploded perspective view of a pressure sensor.
Figure 3B:
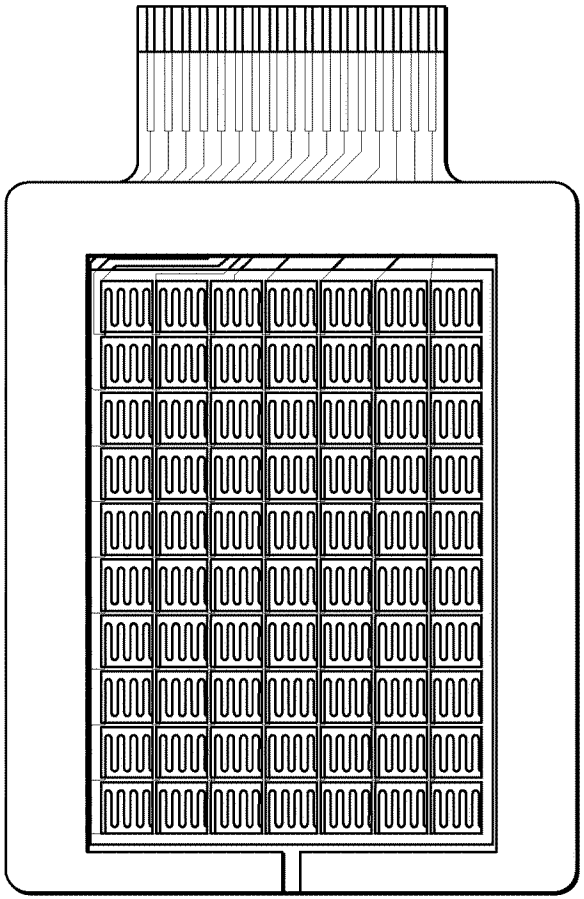
FIG. 3B is an assembled plan view of the same sensor.

Between the impact absorbing material 12 and the inner fabric layer 11 is a sensor 14. This sensor is shown in greater detail in FIGS. 3A and 3B. Another suitable sensor is shown in US2014/0083207.

The sensor 14 comprises two substrate layers 14*a*, 14*b* between which is provided a spacer layer 14*c* and, optionally, one or more dielectric layers 14*d*, 14*e*. The facing surfaces of the substrate layers 14*a*, 14*b* may carry conductive traces of known resistance printed thereon such that when contacting the substrate layers 14*a*, 14*b* provide a variable resistance that depends on the force of contact. Preferably, an array of such force sensing resistor elements is arranged in a grid pattern on the substrates 14*a*, 14*b*. The sensor can be designed in any desired pattern (the grid pattern does not have to be a regular pattern) with the effective sensing grid arranged within.

Figure 4:
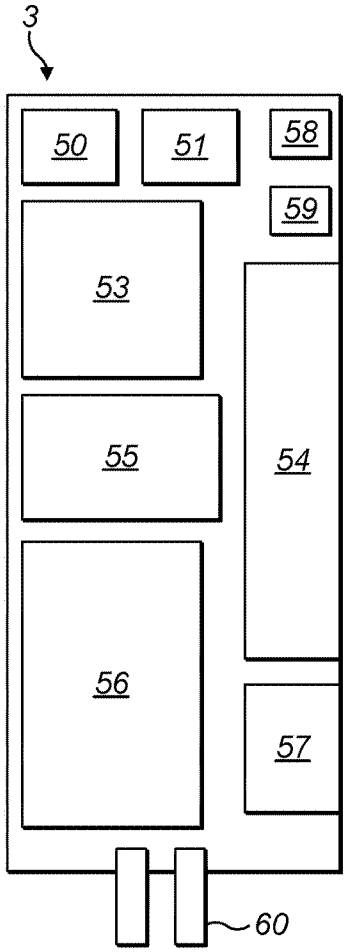
FIG. 4 shows the layout of the control module.

The layout of the control module 3 is shown in FIG. 4. This module contains the following components.

An accelerometer (e.g. ADXL375) which is a three axis accelerometer rated for high g applications. This will measure the acceleration of the wearer during normal motion as well as measuring an abrupt change upon impact.

A gyroscope 51 (e.g. ADXRS290). This may be a 2 or 3 axis gyroscope, which is capable of detecting the angular orientation of the wearer's motion and also any resulting impacts.

A processor 53 (e.g. ARM Cortex M3) which will receive the readings from the pressure sensors 14 from the accelerometer 50 and gyroscope 51 and carry out various calculations and output diagnostic information as set out below.

A connector 54 to connect to the matrix sensor.

A power management integrated circuit 55.

A transceiver 56 such as a Bluetooth device.

A socket 57 via which a battery can be recharged.

An LED 58 which is preferably a multicolour device to provide an indication of device status such as on/off, low battery, charging or the like. It may also be used to provide visual output depending on the magnitude of the impact.

An on/off switch 59 for activating the device.

A battery connection 60 for attachment to a battery such as a lithium ceramic battery which provides a relatively large power source in relatively small volume. Although shown as a separate connection, the battery is preferably part of the control module 3.

Figure 5:
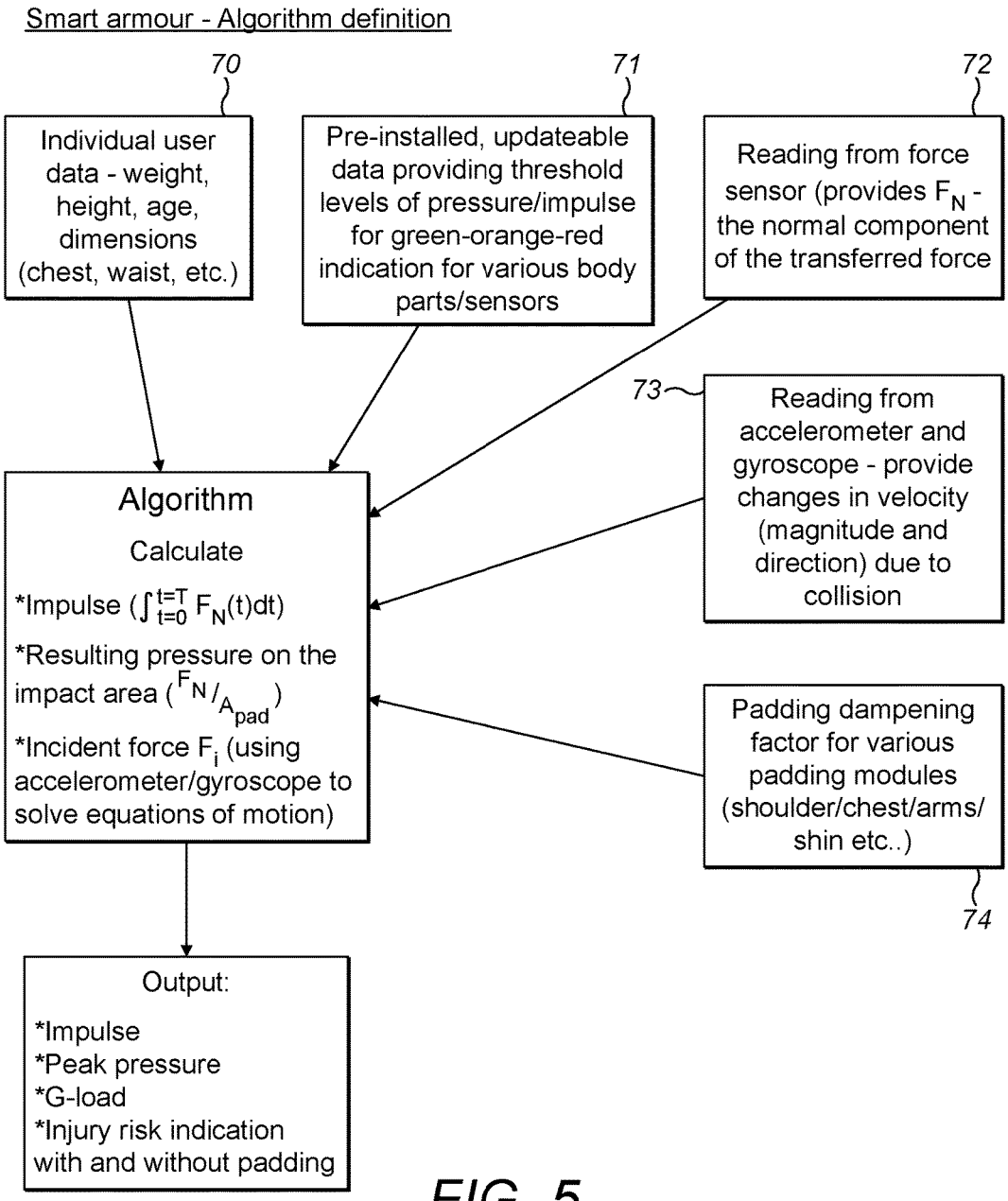
FIG. 5 is a flow chart showing the general operation of the system.

The operation of the present invention will now be described with reference to FIG. 5. The controller 53 receives a number of inputs as described below in order to assess the nature of an impact and to carry out various calculations and to provide useful output.

Certain information is provided by a user before first wearing the garment. This can conveniently be done by providing a user interface 70 such as an app or a website that a user can access when they first use the garment. Information is required on a number of parameters specific to the user such as their weight, height and dimensions such as chest and waist measurements. These are all used in determining the nature of the impact. There may also be an age input to allow the software to determine what might be considered to be an acceptable level of impact.

The software is pre-installed with data 71 concerning the threshold levels of peak pressure and impulse which are considered acceptable. These will include values for an individual impact as well as data concerning cumulative impact. Such values can be set based on existing medical research on safe levels of impact. This aspect of the software is updatable to allow for new information gathered from the latest medical research.

The input from the or each pressure sensor 14 is designated by numeral 72. The sensed value is the normal component of the transmitted force. The pressure sensor 14 provides an indication of the impact force $F_N$ as well as the area $A_{pad}$ over which this force has been applied.

The inputs from the accelerometer 50 and the gyroscope 51 are designated by numeral 73. The padding dampening factor 74 is programmed into the software based on the calibration of the material.

This may be as simple as applying an impact of a known magnitude to the pad and measuring the transmitted force. A more sophisticated calibration may be carried out by applying impacts of different magnitudes to the pad.

All of this information is then received by the processor 53 which can calculate the impulse felt by a user. This is achieved by integrating the force detected by the pressure sensor 14 over time.

Using this data, together with the individual user date, the accelerometer and gyroscope data as well as the padding dampening factor, the algorithm is able to calculate the incident force $F_i$ by solving the equations of motion using laws of momentum and energy conservation.

The output values can include the impulse and the peak pressure both as felt on the outside of the pad and as a peak pressure transmitted to the user, as well as an indication of the risk of injury and an indication of the effectiveness of the padding.

What is claimed is:

1. A wearable garment comprising:

an impact absorbing pad with an inner face facing a body of a wearer and an opposite outer face;

a pressure sensor at the inner face of the impact absorbing pad, positioned so as to measure a force transmitted to the inner face of an impact force on the outer face after a portion of the impact force has been absorbed by the impact absorbing pad; and a means to calculate the impact force on the outer face of the impact absorbing pad based on the force measured at the inner face, the means to calculate the impact force including a control system which is programmed with a padding dampening factor relating to an impact absorbing capacity of the impact absorbing pad.

2. The wearable garment according to claim 1, further comprising an accelerometer and a gyroscope to measure a change in velocity magnitude and direction due to the impact.

3. The wearable garment according to claim 1, wherein an inner fabric layer is provided covering an inner face of the pressure sensor.

4. The wearable garment according to claim 1, wherein an outer fabric layer is provided covering the outer face of the impact absorbing pad.

5. The wearable garment according to claim 1, wherein the pressure sensor is in the form of a matrix array which is able to detect pressure changes across a portion of a width of a impact absorbing pad.

6. The wearable garment according to claim 1, wherein an impact dissipating layer which has a higher flexural rigidity than the impact absorbing pad is provided to dissipate the impact force across a wider area of the pressure sensor.

7. The wearable garment according to claim 1, further comprising a control module with an electrical connection to the pressure sensor.

8. The wearable garment according to claim 7, comprising a plurality of impact absorbing pads each with its own pressure sensor and each being connected to the control module.

9. The wearable garment according to claim 7, wherein the control module further comprises a transceiver which is able to transmit data wirelessly.

10. The wearable garment according to claim 7, wherein the control module comprises a lithium ceramic battery.

11. A system comprising the wearable garment according to claim 1, in combination with a data processing and display device arranged to receive information from the pressure sensor.

12. A system according to claim 11, wherein the processing and display device is arranged to receive data from a plurality of garments.

13. A wearable garment comprising:

an impact absorbing pad with an inner face facing a body of a wearer and an opposite outer face;

a pressure sensor at the inner face of the impact absorbing pad, positioned so as to measure a force transmitted to the inner face of an impact force on the outer face after a portion of the impact force has been absorbed by the impact absorbing pad;

an accelerometer and a gyroscope to measure a change in velocity (magnitude and direction) due to the impact; and a control module with an electrical connection to the pressure sensor, the control module including a processing unit to receive data from the pressure sensor, carry out any required calculation of the impact force, and control the transmission of data as required.

14. The wearable garment according to claim 13, wherein the processing unit calculates a received impulse by integrating the force measured by the pressure sensor over time.

* * * * *